US005336852A

United States Patent [19]

Goch et al.

[11] Patent Number: 5,336,852

[45] Date of Patent: Aug. 9, 1994

[54] ELECTRICAL ASSEMBLY WITH END COLLARS FOR COUPLING ENDS OF A WEATHERSHED HOUSING TO THE END FITTINGS

[75] Inventors: Waymon P. Goch, Clinton; John D. Sakich, Wadsworth, both of Ohio

[73] Assignee: Hubbell Incorporated, Orange, Conn.

[21] Appl. No.: 150,260

[22] Filed: Nov. 10, 1993

Related U.S. Application Data

[60] Continuation of Ser. No. 853,619, Mar. 18, 1992, abandoned, which is a division of Ser. No. 658,848, Feb. 22, 1991, Pat. No. 5,214,249.

[51] Int. Cl.[5] ..... H01B 17/06

[52] U.S. Cl. ..... 174/176; 174/179; 174/140 CR; 174/178; 174/209

[58] Field of Search ..... 174/176, 179, 140 CR, 174/178, 141 R, 140 S, 150, 181, 183, 184, 192, 198, 93, 186; 403/286, 335, 338, 341

[56] References Cited

U.S. PATENT DOCUMENTS

| | | | |
|---|---|---|---|
| 1,239,902 | 9/1917 | Goddard | 174/191 |
| 1,870,833 | 8/1932 | Burr | 174/75 R |
| 2,464,908 | 3/1949 | Volkmann | 174/177 |
| 2,593,955 | 4/1952 | Ackermann | 361/124 |
| 2,728,810 | 12/1955 | Ziehr | 174/75 R |
| 3,290,428 | 12/1966 | Yonkers | 174/73.1 |
| 3,662,082 | 5/1972 | Heppner | 174/18 |
| 3,898,372 | 8/1975 | Kalb | 174/179 |
| 4,198,538 | 4/1980 | Lusk | 174/140 S |
| 4,212,696 | 7/1980 | Lusk et al. | 174/179 X |
| 4,223,179 | 9/1980 | Lusk et al. | 174/73.1 |
| 4,303,799 | 12/1981 | Ishihara et al. | 174/176 |
| 4,343,966 | 8/1982 | Pargmin | 174/140 S |
| 4,373,113 | 2/1983 | Winkler et al. | 174/179 |
| 4,427,843 | 1/1984 | Ishihara et al. | 174/140 S |
| 4,435,615 | 3/1984 | Kaczerginski et al. | 174/189 |
| 4,604,498 | 8/1986 | Kuhl | 174/140.5 |
| 4,851,955 | 7/1989 | Doone et al. | 361/117 |
| 4,905,118 | 2/1990 | Sakich | 174/178 X |

FOREIGN PATENT DOCUMENTS

| | | | |
|---|---|---|---|
| 0914643 | 7/1954 | Fed. Rep. of Germany | 174/74 |
| 2262427 | 9/1975 | France | 174/80 |
| 2419571 | 10/1979 | France | 174/177 |
| 0752512 | 8/1980 | U.S.S.R. | 174/179 |

*Primary Examiner*—Leo P. Picard
*Assistant Examiner*—Hyung S. Sough
*Attorney, Agent, or Firm*—Jerry M. Presson; David L. Tarnoff

[57] ABSTRACT

An electrical assembly, such as an insulator or a surge arrester, utilizing a pair of end collars for coupling an elastomeric weathershed housing to a pair of metallic end fittings, and for reducing electrical stress at the interface of the ends of the weathershed housing and the end fittings, and for sealing the ends of the weathershed housing to the end fittings. In particular, a radially directed force is applied to the weathershed housing by insertion of the core member into the axial bore of the weathershed housing causing radial outward expansion of the weathershed housing into intimate contact with the end collars. Also, each of the ends of the weathershed housing is held in contact against the inner end of the respective end fitting to seal the interface therebetween. Accordingly, a watertight seal is created at the interface between each of the end fittings and the ends of the weathershed housings. The end collars are electrically and mechanically coupled to the end fittings via either a press fit or a set screw for reducing electrical stresses at the interface of the ends of the weathershed housing and the end fittings. The core member can be an insulating rod or a plurality of electrical components, such as metal oxide varistors.

10 Claims, 3 Drawing Sheets

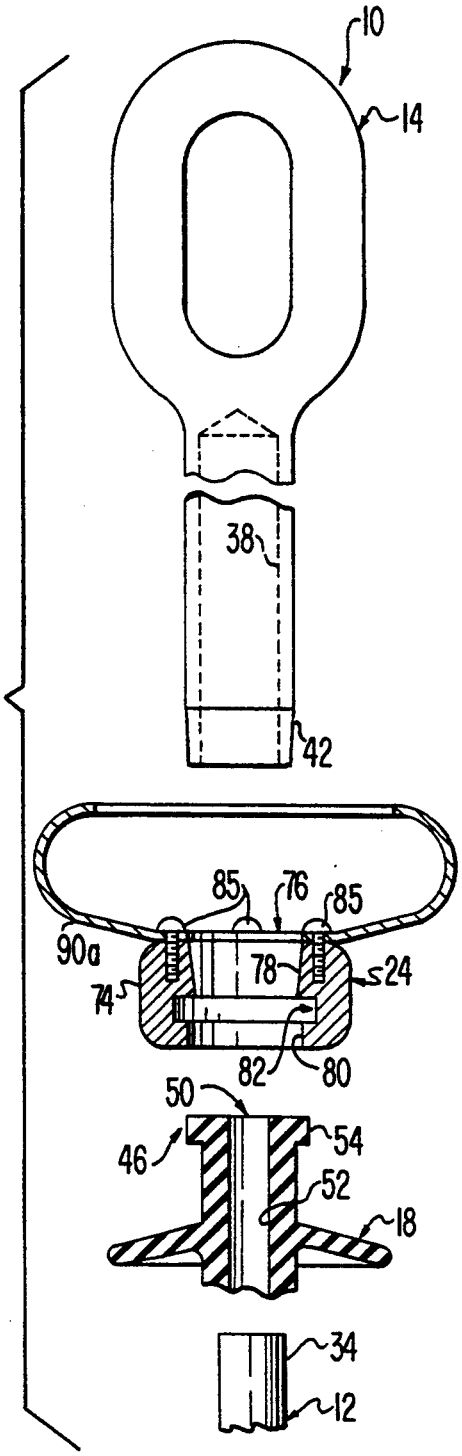
FIG. 4
FIG. 5
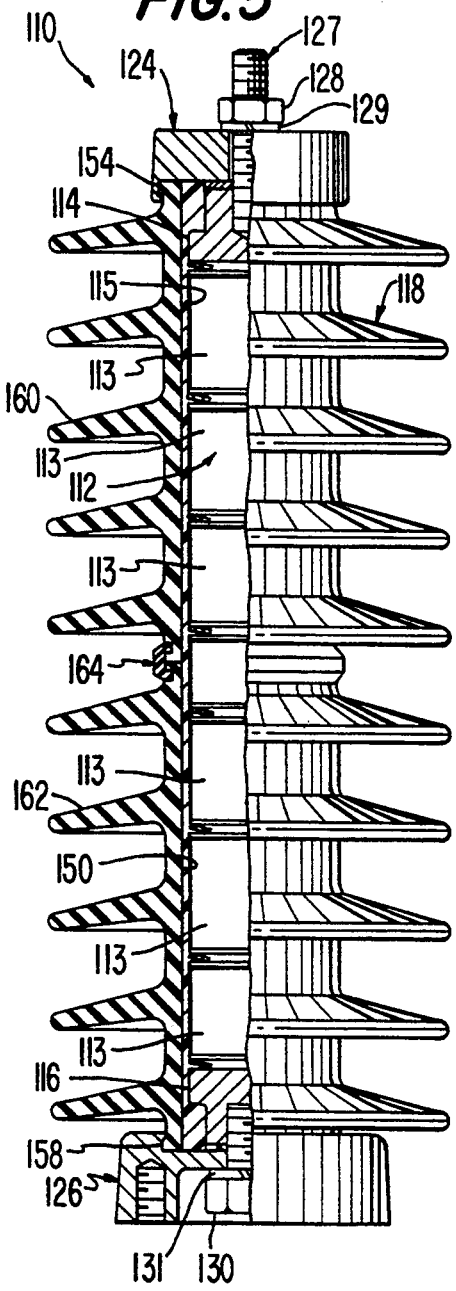

ELECTRICAL ASSEMBLY WITH END COLLARS FOR COUPLING ENDS OF A WEATHERSHED HOUSING TO THE END FITTINGS

This is a continuation of application Ser. No. 07/853,619 filed on Mar. 18, 1992 (now abandoned) which is a division of application Ser. No. 07/658,848 filed Feb. 22, 1991, now U.S. Pat. No. 5,214,249.

FIELD OF THE INVENTION

This invention relates to an electrical assembly, such as an insulator or a surge arrester, having a pair of end collars for coupling ends of an elastomeric weathershed housing to the end fittings of the insulator or surge arrester. More specifically, the invention relates to end collars for coupling and sealing the ends of an elastomeric weathershed housing to the metallic end fittings by applying a radially directed force on the ends of the weathershed housing to ensure intimate contact between the weathershed housing and the end collars, and by maintaining contact between the ends of the weathershed housing and the end fittings.

BACKGROUND OF THE INVENTION

Electrical assemblies, such as insulators and surge arresters, are typically enclosed within a weathershed housing for insulating and protecting the internal electrical components or core members from the outside environment. Insulators are extensively used to support the electrical conductors of electric power lines. Surge arresters, on the other hand, are commonly connected across electrical equipment to shunt over-voltage surges, such as lightning strikes. Two problems common to both insulators and arresters are reducing electrical stresses at the end fittings, and preventing water ingress at the interface between the end fittings and the ends of the weathershed housings.

While many attempts have been made to overcome these problems, numerous disadvantages are present in these prior electrical assemblies. For example, many of the prior electrical assemblies have end fittings with an integral end collar which is crimped about the end portion of the weathershed housing. These end fittings with integral end collars are typically difficult and expensive to manufacture. Moreover, these type of end fittings often do not provide an effective seal.

Examples of these prior electrical assemblies are disclosed in the following U.S. Pat. Nos. 2,464,908 to Volkman; 2,593,955 to Ackermann; 2,728,810 to Ziehr; 3,290,428 to Yonkers; 3,662,082 to Heppner; 3,898,372 to Kalb; 4,198,538 to Lusk; 4,212,696 to Lusk et al; 4,303,799 to Ishihara; 4,343,966 to Pargamin; 4,427,843 to Ishihara et al; 4,435,615 to Kaczerginski et al; and 4,604,498 to Kuhl.

In view of the above, it is apparent that there exists a need to provide electrical assemblies with end collars for reducing electrical stresses at the ends of the electrical assembly, and for coupling and sealing the end fittings and the ends of the weathershed housing together in a weathertight manner. This invention addresses these needs in the art along with other needs which will become apparent to those skilled in the art once given this disclosure.

SUMMARY OF THE INVENTION

Accordingly, a primary object of the invention is to provide an electrical assembly which utilizes a pair of metallic end collars for reducing electrical stresses at the end fittings and for providing a greatly improved weathertight seal between the metallic end fittings and the elastomeric weathershed housing.

Another object of the invention is to provide an electrical assembly utilizing an end collar and an elastomeric weathershed housing which are coupled together by applying a radially outwardly extending force to the weathershed housing for causing outward radial pressure of the end portions of the weathershed housing against the end collar.

Another object of the invention is to provide an electrical assembly which is relatively inexpensive and simple to manufacture and assemble.

A further object of the invention is to provide an electrical assembly utilizing an elastomeric weathershed housing which is forgiving of dimensional variations in its associated parts, thereby reducing the need for expensive close tolerances to provide an effective seal at the end fittings.

The foregoing objects are basically attained by an electrical assembly, the combination comprising: a core member having a first end, a second end and an outer surface with a predetermined outer cross-sectional width; a weathershed housing formed of an elastomeric material, and having a first end, a second end, and an axially extending bore with a predetermined cross-sectional width for receiving the core member therein, each of the first and second ends of the weathershed housing having a portion with a predetermined outer cross-sectional width; a first end fitting fixedly coupled to the first end of the core member; and a first coupling assembly for coupling and sealing the first end Of the weathershed housing to the first end fitting, the first coupling and sealing assembly including a first collar having an axially extending bore with an inner cross-sectional width for receiving the portion of the first end of the weathershed housing, the inner cross-sectional width of the first collar and the outer cross-sectional width of the portion of the first end of the weathershed housing being sized to intimately contact one another upon inserting the core member into the bore of the weathershed housing, causing outward radial pressure of the portion of the first end of the weathershed housing against the bore of the first collar.

The foregoing objects are also basically attained by an end collar for coupling and sealing an end of an elastomeric weathershed housing to a metallic end fitting, comprising: a tubular member having a first end, a second end and an axially extending bore extending between the first and second ends, the bore including a frustoconical inner surface portion for electrically coupling the tubular member to a tapered portion of the end fitting; and an annular groove for receiving a portion of the weathershed housing therein.

The foregoing objects are also attained by an end collar for coupling and sealing an end of an elastomeric weathershed housing to a metallic end fitting, comprising: a tubular member having a first end, a second end, an outer surface extending between the first and second ends, an axially extending bore extending between the first and second ends, and a threaded hole extending through said outer surface into the bore, the bore including a first cylindrical inner surface portion adjacent the first end for receiving a portion of the end fitting therein, an annular recess formed in the first cylindrical surface and communicating with the threaded hole for receiving sealant injected into the bore through the threaded hole, and an annular groove for receiving a portion of the weathershed housing therein; and a set screw threadedly received in the threaded hole for electrically and mechanically coupling the tubular member to the end fitting.

Other objects, advantages and salient features of the invention will become apparent from the following detailed description, which, taken in conjunction with the annexed drawings, discloses several preferred embodiments of the invention.

BRIEF DESCRIPTION OF THE DRAWINGS

Referring to the drawings which form a part of this original disclosure:

FIG. 4 is an enlarged, exploded, side elevational view in partial section of the upper end of the electrical assembly illustrated in FIG. 1 with a corona shield coupled to the upper end of the top end collar;

FIG. 5 is a side elevational view in partial cross section of a second embodiment of an electrical assembly in the form of a surge arrester, in accordance with the present invention;

DETAILED DESCRIPTION OF THE INVENTION

Figure 1:
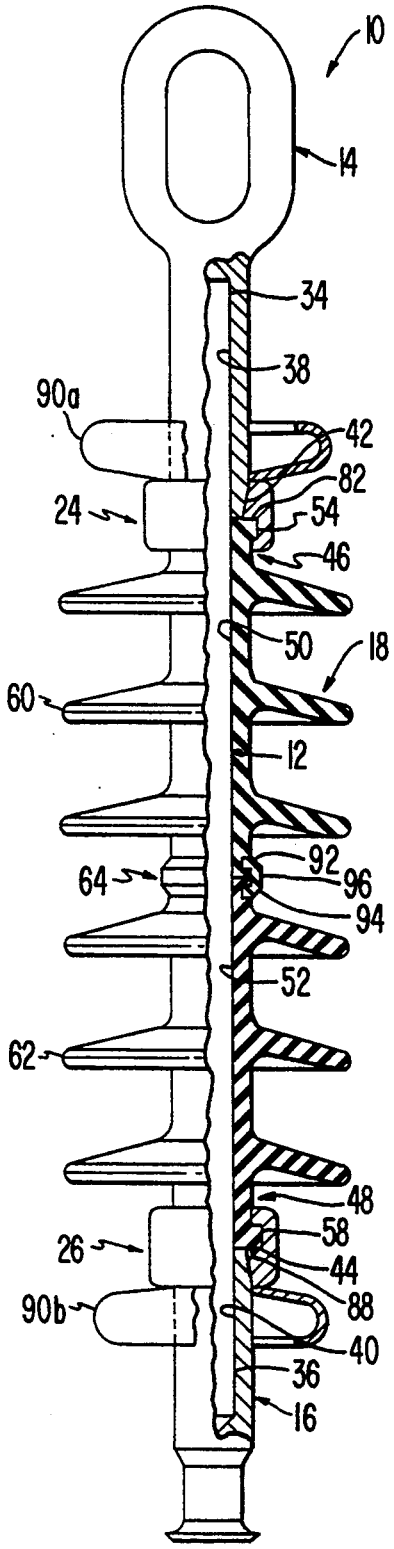
FIG. 1 is a side elevational view in partial section of an electrical assembly in the form of an electrical insulator in accordance with one embodiment of the present invention.

Initially referring to FIG. 1, an electrical assembly 10 according to the present invention is illustrated in the form of an insulator. Electrical assembly 10 includes an insulating core member 12, a first end fitting or connector 14 coupled to the upper end of core member 12, a second end fitting or connector 16 coupled to the lower end of core member 12, an elastomeric weathershed housing 18 overlying and enclosing the portion of core member 12 between end fittings 14 and 16, a first or top metallic end collar 24 for coupling and sealing the upper end of weathershed housing 18 to end fitting 14, and a second or bottom metallic end collar 26 for coupling the lower end of weathershed housing 18 to end fitting 16.

Core member 12 is illustrated as an elongated cylindrical insulating rod, which is preferably composed of fiberglass reinforced epoxy, vinylester or polyester resin. Core member 12 also can be formed from other electrical components, such as varistors, resistors, capacitors, electrical conductors or any combination thereof. Core member 12, as seen in FIG. 1, has a substantially uniform outer diameter with its upper and lower ends 34 and 36 fixedly coupled to end fittings 14 and 16 in a conventional manner, such as crimping or swaging.

End fittings 14 and 16 are conventional metallic end fittings, and thus will not be discussed in detail. End fittings 14 and 16 have axially extending bores 38 and 40, respectively, for receiving upper and lower ends 34 and 36 of core member 12 therein to fixedly couple them together by crimping. Each of the end fittings 14 and 16 has a tapered shaft portion 42 and 44, respectively, for fixedly coupling end collars 24 and 26 thereto by a press fit as discussed in more detail below.

Weathershed housing 18 has a first or upper end portion 46 and a second or lower end portion 48 with an axially extending through bore 50 extending between upper end portion 46 and lower end portion 48. Preferably, weathershed housing 18 is composed of a polymeric, elastomeric material having sufficient resiliency to be expanded radially outwardly upon insertion of core member 12 into axially extending bore 50.

Bore 50 preferably has a substantially uniform cylindrical inner surface 52 with an internal diameter, or cross-sectional width, which is smaller than or equal to the diameter, or cross-sectional width, of core member 12 when in its unstressed state. Bore 50 or core member 12 can be coated with a viscous insulating material, such as silicone grease, to prevent the ingress of contaminants along the interface of core member 12 and bore 50 of weathershed housing 18. Alternatively, bore 50 can have a series of annular grooves filled with a viscous insulating material as disclosed in U.S. Pat. No. 3,898,372 to Kalb, which is hereby incorporated herein by reference.

Weathershed housing 18, for short electrical assemblies, can be made of a single, unitary elastomeric housing or, for long electrical assemblies, can be made of two or more elastomeric weathershed sections 60 and 62 with adjacent ends of the weathershed sections being coupled together by an insulating collar 64 as seen in FIG. 1.

As seen in FIGS. 1 and 4, upper end portion 46 of weathershed housing 18 has an outwardly extending annular end flange 54, which is coupled to top end collar 24 for sealing the interface between weathershed housing 18 and end fitting 14 as discussed below in more detail. Alternatively, annular end flange 54 can be formed by an outwardly opening annular recess.

As seen in FIG. 1, second or lower end portion 48 of weathershed housing 18 has an outwardly extending annular end flange 58, which is coupled to bottom end collar 26 for sealing the interface between weathershed housing 18 and lower end fitting 16, as discussed below in more detail. Alternatively, annular end flange 58 can be formed by an outwardly opening annular recess.

As seen in FIG. 1, end collars 24 and 26 are substantially identical, except that they face in opposite directions. Accordingly, only end collar 24 will be discussed and illustrated in detail.

Figure 2:
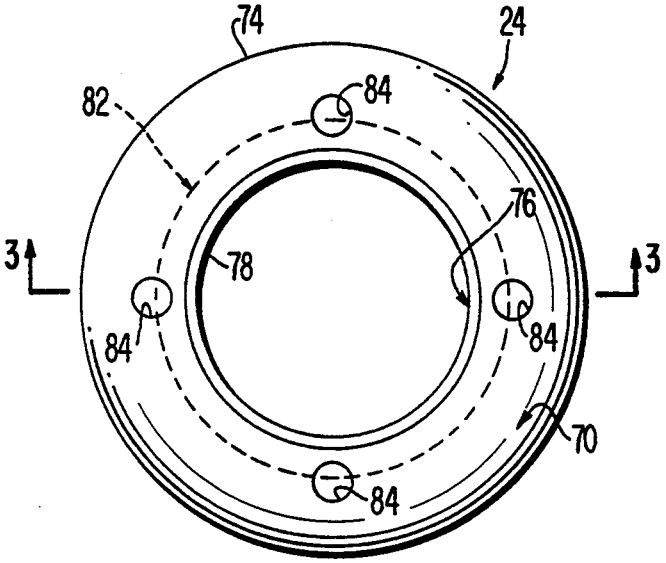
FIG. 2 is an enlarged, top plan view of the top end collar of the electrical assembly illustrated in FIG. 1.
Figure 3:
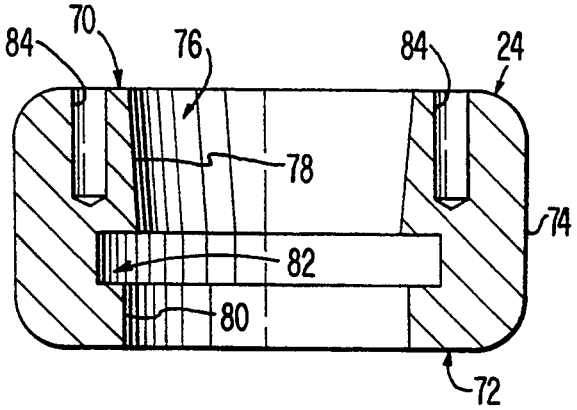
FIG. 3 is an enlarged, side elevational view in longitudinal cross section of the top end collar of the electrical assembly illustrated in FIGS. 1 and 2 taken along line 3—3 in FIG. 2.

Referring to FIGS. 2 and 3, top end collar 24 has a first or outer end 70 and a second or inner end 72 with a substantially cylindrical outer surface 74 extending therebetween, and an axially extending bore 76. Bore 76 has a frustoconical inner surface portion 78 sloping inwardly and downwardly from outer end 70 towards inner end 72, a cylindrical inner surface portion 80 adjacent inner end 72 and an annular groove 82 located between inner surface portion 78 and inner surface portion 80. End collar 24 is made of any suitable electrically conductive material, such as aluminum.

Referring to FIGS. 2 and 4, first or outer end 70 is optionally provided with four axially extending bores 84 for receiving suitable fasteners 85, such as self tapping screws, to fixedly couple a corona shield 90*a* thereto. Corona shield 90a is made of any suitable electrically conductive material, such as aluminum or steel.

Frustoconical inner surface portion 78 slopes approximately 2.5 degrees outwardly from the longitudinal axis of end collar 24 towards first or outer end 70. Accordingly, tapered portion 42 of end fitting 14 slopes approximately 2.5 degrees inwardly towards its longitudinal axis and its free end. This allows end collar 24 to be press-fitted onto end fitting 14 to provide a watertight seal and to ensure firm electrical contact therebetween.

End flange 54 of weathershed housing 18 is fitted into annular groove 82 and forced into intimate contact with end collar 24 upon insertion of core member 12 into bore 50 of weathershed housing 18 to provide an effective seal between weathershed housing 18 and end fitting 14. The outer diameter of end flange 54 can be smaller than, larger than, or equal to the inner diameter of annular groove 82 depending upon the amount of radial expansion of weathershed housing 18 occurring by insertion of core member 12 into bore 50.

End collar 24 is fixedly coupled to end fitting 14 by pressing end fitting 14 into bore 76, until it firmly engages end collar 24 by a friction or press fit. The press fit mechanically and electrically couples end collar 24 to end fitting 14. In particular, frustoconical portion 78 of end collar 24 firmly engages tapering portion 42 of end fitting 14 to seal and to ensure firm electrical contact therebetween. Preferably, the free end of tapering portion 42 contacts the upper end of weathershed housing 18, upon press-fitting end collar 24 onto end fitting 14 to seal the interface therebetween. Sufficient contact between the free ends of the end fittings 14 and 16 and the upper and lower ends of weathershed housing 18 can be maintained by axially compressing weathershed housing 18 between end fittings 14 and 16 for sealing the interfaces between the ends of weathershed housing 18 and end fittings 14 and 16.

End collar 26 is similarly coupled to end fitting 16 by a press fit, and flange 58 of weathershed housing 18 is received in annular groove 88 of end collar 26 to seal lower end portion 48 of weathershed housing 18. As particularly seen in FIGS. 1, an optional metallic corona shield 90b is rigidly coupled to end collar 26 by fasteners in the same manner in which corona shield 90a is coupled to end collar 24 as discussed above.

Alternatively, end collars 24 and 26 can be electrically and mechanically coupled to end fittings 14 and 16 by other suitable connections such as a set screw or crimping.

As particularly seen in FIG. 1, insulating collar 64 has a substantially C-shaped transverse cross section with a pair of annular leg portions 92 and 94 extending radially inwardly from a bight portion 96. Bight portion 96 and leg portions 92 and 94 define an annular coupling groove for receiving annular flanges of weathershed sections 60 and 62, respectively. Preferably, insulating collar 64 is made of a polymeric, elastomeric material, such as alumina trihydrate (ATH) filled ethylene propylene monomers (EPM), ethylene propylene dienemonomers (EPDM) and silicone elastomers, or filled epoxy, or filled polyester. Insulating collar 64 and the coupling of weathershed sections 60 and 62 are more fully described in the copending U.S. Pat. application Ser. No. 609,753 (now U.S. Pat. No. 5,159,158) entitled "Electrical Assembly with Insulating Collar for Coupling Sections of Weathershed Housings", filed on Nov. 7, 1990 in the name of John D Sakich and Waymon P Goch, and which is hereby incorporated herein by reference.

ASSEMBLY OF ELECTRICAL ASSEMBLY 10

Preferably, electrical assembly 10, illustrated in FIGS. 1–4, is assembled by first stretching or expanding insulating collar 64 over the adjacent end portions of weathershed sections 60 and 62. Then insulating collar 64 is permitted to contract to its original unstressed diameter, and thereby slightly compressing or collapsing the adjacent end portions of weathershed sections 60 and 62 inwardly.

Next, end collars 24 and 26 are coupled to weathershed housing 18 by squeezing or compressing the upper and lower end portions 46 and 48 of weathershed housing 18, and inserting them into bores 76 and 86 of end collars 24 and 26, respectively. Upper end portion 46 then expands radially outwardly with flange 54 seating in annular groove 82 of end collar 24, while lower end portion 48 expands radially outwardly with flange 58 seating in annular groove 88.

Now, bottom end fitting 16 is crimped or swaged onto core member 12. Core member 12 is then inserted into bore 50 of weathershed housing 18 to expand, or dilate, weathershed housing 18 radially outwardly, thereby providing an interference fit between the entire length of core member 12 and inner surface 52 weathershed housing 18. The outward radial expansion of weathershed housing 18 by core member 12 produces a radially outwardly directed and extending force. This radially directed force causes end portions 46 and 48 of weathershed housing 18 to move outwardly into intimate contact with end collars 24 and 26, respectively. In other words, this radially directed force causes outward radial pressure on and presses the end portions 46 and 48 of weathershed housing 18, especially flanges 54 and 58, against the respective end collars 24 or 26 to provide a weathertight seal therebetween as seen in FIG. 1. In applications where electrical assembly 10 is subjected to high pressure washings, end collars 24 and 26 can also be adhesively bonded to weathershed housing 18 by sealants or adhesive sealants for additional sealing at the interface of weathershed housing 18 and end collars 24 and 26.

Next, weathershed housing 18 is axially compressed downwardly to allow end fitting 14 to be slid over upper end of core member 12 and then crimped or swaged onto core member 12 for fixedly coupling end fitting 14 to core member 12. Weathershed housing 18 is now held under a uniform axial compression by end fittings 14 and 16. The end collars 24 and 26 are driven onto the tapered portions of end fittings 14 and 16, respectively, to force the ends of the end fittings 14 and 16 against the upper and lower ends of weathershed housing 18 for sealing the interface therebetween, and to complete the assembly.

EMBODIMENT OF FIG. 5

Referring now to FIG. 5, an electrical assembly 110 in accordance with the present invention is illustrated in the form of a surge arrester. Electrical assembly 110 includes a core member 112, a pair of end fittings 114 and 116 electrically coupled to the ends of core member 112, a weathershed housing 118 with a pair of weathershed sections 160 and 162 coupled together by an insulating collar 164, and a pair of end collars or sealing caps 124 and 126. Weathershed housing 118 and insulating collar 164 are substantially identical to weathershed housing 18 and insulating collar 64 of electrical assembly 10. Accordingly, the construction and assembly of weathershed housing 118 and collar 164 will not be discussed in detail herein.

Core member 112 of this embodiment utilizes a plurality of metal oxide varistor blocks 113 which are wrapped in fiberglass 115, and which are electrically connected together and to end fittings 114 and 116.

Core member 112 and end fittings 114 and 116 are discussed in detail in U.S. Pat. Nos. 4,899,248 to Raudabaugh and 4,905,118 to Sakich, the subject matter of which are both hereby incorporated herein by reference.

Insertion of core member 112 into the weathershed housing 118 forces the ends of weathershed housing 118, especially end flanges 154 and 158, radially outwardly to provide a weathertight seal between end collars 124 and 126 and weathershed housing 118 as discussed above regarding the embodiment of FIGS. 1–4. In particular, core member 112 applies radially outwardly directed forces causing outward radial movement and pressure of end flanges 154 and 158 against end collars 124 and 126. End collar 124 is electrically coupled to end fittings 114 via threaded stud 127, nut 128 and washer 129, while end collar 126 is electrically coupled to end fitting 116 via bolt 130 and washer 131.

ASSEMBLY OF ELECTRICAL ASSEMBLY 110

Preferably, electrical assembly 110, illustrated in FIG. 5, is assembled by first stretching or expanding insulating collar 164 over the adjacent end portions of weathershed sections 160 and 162. Then insulating collar 164 is permitted to contract to its original unstressed diameter, and thereby slightly compressing or collapsing the adjacent end portions of weathershed sections 160 and 162 inwardly.

Next, end collar 124 is coupled to weathershed housing 118 by squeezing or compressing the upper end portion of weathershed housing 118, and inserting it into the bore of end collar 124. The upper end portion of the weathershed housing 118 then expands radially outwardly with flange 154 seating in the annular groove of end collar 124. The end collar 124 is electrically and mechanically coupled to end fitting 114 via threaded stud 127, nut 128 and washer 129.

Core member 112 is then inserted into bore 150 of weathershed housing 118 to expand, or dilate, weathershed housing 118 radially outwardly, thereby providing an interference fit between the entire length of core member 112 and the inner surface of weathershed housing 118. The outward radial expansion of weathershed housing 118 by core member 112 produces a radially outwardly directed and extending force. This radially directed force causes the upper end portion of weathershed housing 118 to move outwardly into intimate contact with end collar 124.

Now, weathershed housing 118 is axially stretched downwardly such that the lower end portion of weathershed housing 118 is no longer contacting core member 112. Lower end collar 126 is then coupled to weathershed housing 118 by squeezing or compressing the lower end portion of weathershed housing 118, and inserting it into the bore of end collar 126. The lower end portion of weathershed housing 118 then expands radially outwardly with flange 158 seating in the annular groove of end collar 126.

Finally, weathershed housing 118 is permitted to contract to its original unstressed state, and is then axially compressed by end collar 126 being electrically and mechanically coupled to end fitting 116 by bolt 130.

In applications where electrical assembly 110 is subjected to high pressure washings, end collars 124 and 126 can also be adhesively bonded to weathershed housing 118 by sealants or adhesive sealants for additional sealing at the interface of weathershed housing 118 and end collars 124 and 126.

EMBODIMENT OF FIGS. 6 AND 7

Figure 6:
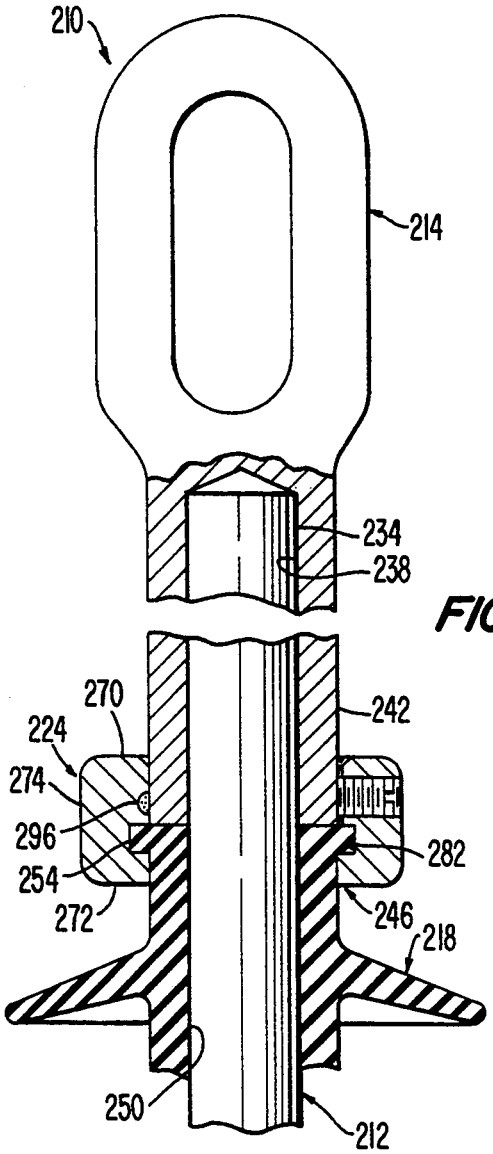
FIG. 6 is a partial, side elevational view in longitudinal cross section of a third embodiment of an electrical assembly in the form of an electrical insulator.
Figure 7:
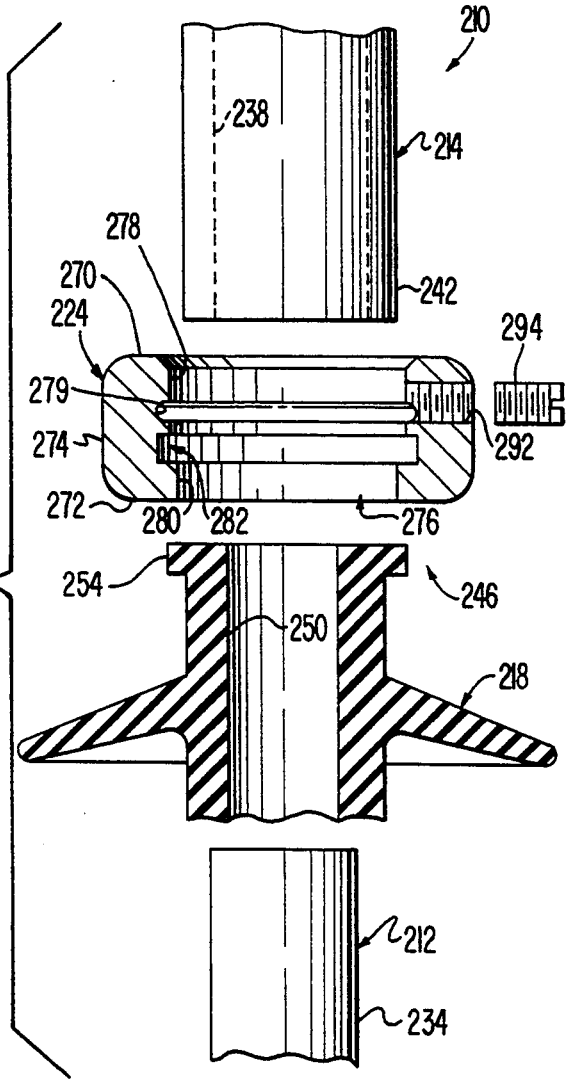
FIG. 7 is an enlarged, exploded side elevational view in longitudinal cross section of the top end collar of the electrical assembly illustrated in FIG. 6.

Referring now to FIGS. 6 and 7, an electrical assembly 210 in accordance with present invention is illustrated in the form of an electrical insulator. Electrical assembly 210 is substantially identical to electrical assembly 10, except that the end fittings and the metallic end collars have been modified. Accordingly, electrical assembly 210 will not be described or illustrated in detail herein.

The upper end of electrical assembly 210 has a first or upper end fitting 214 coupled to the upper end 234 of core member 212 via crimping with an elastomeric weathershed housing 218 overlying and enclosing a portion of core member 212. A first or top metallic end collar 224 couples the upper end 254 of weathershed housing 218 to upper end fitting 214 for sealing the interface therebetween.

Core member 212 is illustrated as an elongated cylindrical insulating rod, which is preferably composed of fiberglass reinforced epoxy, vinylester or polyester resin. Core member 212 also can be formed from other electrical components, such as varistors, resistors, capacitors, electrical conductors, or any combination thereof. Core member 212, as seen in FIG. 6, has a substantially uniform outer diameter with its upper end 234 fixedly coupled to end fitting 214 in a conventional manner, such as crimping or swaging.

End fitting 214 is a conventional metallic end fitting, and thus will not be discussed in detail. End fitting 214 has an axially extending bore 238 for receiving upper end 234 of core member 212 therein to fixedly couple them together by crimping. End fitting 214 has a cylindrical shaft portion 242 for fixedly coupling end collar 224 thereto as discussed in more detail below.

Weathershed housing 218 has a first or upper end portion 246 with an axially extending through bore 250 for receiving core member 212 therein. Preferably, weathershed housing 218 is composed of a polymeric, elastomeric material having sufficient resiliency to be expanded radially outwardly upon insertion of core member 212 into axially extending bore 250.

Referring to FIG. 7, top end collar 224 has a first or outer end 270 and a second or inner end 272 with a substantially cylindrical outer surface 274 extending therebetween, and an axially extending bore 276. End collar 224 is made of any suitable electrically conductive material, such as aluminum. Bore 276 has a first cylindrical inner surface portion 278 adjacent outer end 270, an annular recess 279 formed in first inner surface portion 278, a second cylindrical inner surface portion 280 adjacent inner ends 272 and an annular groove 282 located between first inner surface portion 278 and second inner surface portion 280.

A threaded hole 292 extends axially through the wall of end collar 224 from outer surface 274 to first inner surface portion 278 and annular recess 279. A set screw 294 is threadedly received in threaded hole 292 for electrically and mechanically connecting end collar 224 to end fitting 214.

End flange 254 of weathershed housing 218 is fitted into annular groove 282 and forced into intimate contact with end collar 224 upon insertion of core member 212 into bore 250 of weathershed housing 218 to provide an effective seal between weathershed housing 218 and end fitting 214. The outer diameter of end flange 254 can be smaller than, larger than, or equal to the inner diameter of annular groove 282 depending upon the amount of radial expansion of weathershed housing 218 occurring by insertion of core member 212 into bore 250.

End collar 224 is fixedly coupled to end fitting 214 by threading set screw 294 into threaded hole 292 until set screw 294 firmly contacts end fitting 214. Preferably, set screw 294 is torqued to about 80 inch-pounds to insure firm contact with end fitting 214 for electrically and mechanically coupling end collar 224 to end fitting 214.

Hole 292 also serves as an access port for injecting sealant 296 into annular recess 279. The sealant 296 then flows through, fills and overflows annular recess 279 and engages end fitting 214 for sealing the interface between end fitting 214 and the upper end 246 of weathershed housing 218. In particular, the diameter of first inner surface portion 278 of end collar 224 is slightly larger than the diameter of the shaft portion 242 of end fitting 214 to form a clearance fit therebetween. This clearance fit permits sealant 296 to flow upwardly between the interface of end fitting 214 and end collar 224, and downwardly between the interface of end fitting 214 and end collar 224 to seal the interface between the upper end 246 of weathershed housing 218 and end fitting 214.

ASSEMBLY OF ELECTRICAL ASSEMBLY 210

Preferably, electrical assembly 210, illustrated in FIGS. 6 and 7, is assembled by coupling the end collars (only one shown) to weathershed housing 218 by squeezing or compressing the upper and lower end portions of weathershed housing 218, and inserting them into the bores of the end collars. As seen in FIG. 6, upper end portion 246 expands radially outwardly with flange 254 seating in annular groove 282 of end collar 224. Similarly, the lower end portion expands radially outwardly with its flange seating in the annular groove of the lower end collar (not shown).

Now, the bottom end fitting (not shown) is crimped or swaged onto core member 212. Core member 212 is then inserted into bore 250 of weathershed housing 218 to expand, or dilate, weathershed housing 218 radially outwardly, thereby providing an interference fit between the entire length of core member 212 and the inner surface weathershed housing 218. The outward radial expansion of weathershed housing 218 by core member 212 produces a radially outwardly directed and extending force. This radially directed force causes the end portions of weathershed housing 218 to move outwardly into intimate contact with the end collars. In other words, this radially directed force causes outward radial pressure which presses the end portions of weathershed housing 218, especially the flanges, against the end collars to provide a weathertight seal therebetween as seen in FIG. 6.

Next, weathershed housing 218 is axially compressed downwardly to allow end fitting 214 to be slid over the upper end of core member 212, and then crimped or swaged onto core member 212 for fixedly coupling end fitting 214 to core member 212. Weathershed housing 218 is now held under a uniform axial compression by the end fittings. This axial compression causes the upper and lower ends of weathershed housing 218 to press against the axially-facing inner ends of the end fittings for sealing the interfaces therebetween.

Now, sealant 296 is injected through threaded hole 292 into annular recess 279, until the sealant flows from annular recess 279 between the entire interface of end fitting 214 and end collar 224. In particular, sealant 296 flows in both directions out of annular recess 279, i.e., towards outer end 270 and towards inner end 272 to seal the interfaces between the end fitting 214 and the weathershed housing 218 and the end fitting 214 and the end collar 224. Finally, set screw 294 is threaded into threaded hole 292, until set screw 294 firmly contacts end fitting 214 to electrically and mechanically couple end collar 224 to end fitting 214.

While only three embodiments have been chosen to illustrate the invention, it will be understood by those skilled in the art that various changes and modifications can be made herein without departing from the scope of the invention as defined in the appended claims.

What is claimed is:

1. An electrical assembly, comprising;

a core member with an end fitting coupled to one end;

an elastomeric weathershed housing overlying a portion of said core member;

a tubular end collar having a first end, a second end and an axially extending bore extending between said first and second ends for receiving a portion of said weathershed housing and a tapered portion of said end fitting, said bore including a frustoconical inner surface portion with an inner diameter sized to receive said end fitting for electrically and mechanically coupling said tubular end collar to said tapered portion of said end fitting by press-fitting said tubular end collar onto said end fitting, said frustoconical inner surface sloping inwardly from said first end towards said second end to narrow said axially extending bore as said frustoconical inner surface approached said second end; and an annular groove with an inner diameter sized to receive an end flange of said weathershed housing, said annular groove being positioned between said second end and said frustoconical inner surface for receiving said end flange of said weathershed housing therein to couple said tubular end collar to said weathershed housing.

2. An electrical assembly according to claim 1, wherein said tubular end collar is made of an electrically conductive material.

3. An electrical assembly according to claim 2, wherein said electrically conductive material of said tubular end collar is aluminum.

4. An electrical assembly according to claim 2, wherein said axially extending bore for receiving said weathershed housing and said end fitting further includes a cylindrical inner surface portion adjacent said second end.

5. An electrical assembly according to claim 4, wherein said annular groove is located between said frustoconical inner surface portion and said cylindrical inner surface portion.

6. An end collar for coupling and sealing an end of an elastomeric weathershed housing to a metallic end fitting, comprising:

a tubular member having a first end, a second end and an axially extending bore extending between said first and second ends, said bore including a frustoconical inner surface portion for electrically and mechanically coupling said tubular member to a tapered portion of the end fitting by press-fitting said tubular member onto the end fitting, said frustoconical inner surface portion sloping inwardly from said first end towards said second end to narrow said axially extending bore as said frustoconical inner surface portion approaches said second end; and an annular groove positioned between said second end and said frustoconical inner surface portion for receiving a portion of the weathershed housing therein, said tubular member being made of an electrically conductive material and having a corona shield fixedly coupled thereto.

7. An end collar for coupling and sealing an end of an elastomeric weathershed housing to a metallic end fitting, comprising:

a tubular member having a first end, a second end, an outer surface extending between said first and second ends, an axially extending bore extending between said first and second ends, and a threaded hole extending through said outer surface into said bore, said bore including a first cylindrical inner surface adjacent said first end for receiving a portion of the end fitting therein, an annular recess formed in said first cylindrical surface portion and communicating with said threaded hole for receiving sealant injected into said bore through said threaded hole, and an annular groove formed in said bore between said annular recess and said second end for receiving a portion of the weathershed housing therein; and a set screw threadedly received in said threaded hole for electrically and mechanically coupling said tubular member to the end fitting.

8. An end collar according to claim 7, wherein said tubular member is made of an electrically conductive material.

9. An end collar according to claim 8, wherein said electrically conductive material is aluminum.

10. An end collar according to claim 8, wherein said bore further includes a second cylindrical inner surface portion adjacent said second end.

* * * * *